US008648883B2

(12) United States Patent
Han et al.

(10) Patent No.: US 8,648,883 B2
(45) Date of Patent: Feb. 11, 2014

(54) DISPLAY APPARATUS AND METHOD OF DRIVING THE SAME

(75) Inventors: Eun-Hee Han, Seoul (KR); Hee-Seop Kim, Hwaseong-si (KR); Chang-Hun Lee, Yongin-si (KR); Jun-Woo Lee, Anyang-si (KR)

(73) Assignee: Samsung Display Co., Ltd., Yongin (KR)

( * ) Notice: Subject to any disclaimer, the term of this patent is extended or adjusted under 35 U.S.C. 154(b) by 1631 days.

(21) Appl. No.: 11/928,630

(22) Filed: Oct. 30, 2007

(65) Prior Publication Data

US 2008/0122874 A1 May 29, 2008

(30) Foreign Application Priority Data

Nov. 15, 2006 (KR) ..... 10-2006-0112969

(51) Int. Cl.
*G09G 5/10* (2006.01)

(52) U.S. Cl.
USPC ..... 345/690

(58) Field of Classification Search
USPC ..... 345/690, 87–104
See application file for complete search history.

(56) References Cited

U.S. PATENT DOCUMENTS

2003/0214725 A1* 11/2003 Akiyama ..... 359/640
2004/0041781 A1* 3/2004 Sato et al. ..... 345/102

* cited by examiner

*Primary Examiner* — Sumati Lefkowitz
*Assistant Examiner* — Robert E Carter, III
(74) *Attorney, Agent, or Firm* — H.C. Park & Associates, PLC

(57) ABSTRACT

In a display apparatus and a method of driving the same, an active period during which one pixel is turned on is divided into a red sub frame, a green sub frame, a blue sub frame, and a white sub frame. A controller compares a gray scale of a fourth image data corresponding to the white sub frame with a reference gray scale and compensates a first image data, a second image data, and a third image data corresponding to the red, green, and blue sub frames, respectively, in accordance with the comparison result.

14 Claims, 8 Drawing Sheets

DISPLAY APPARATUS AND METHOD OF DRIVING THE SAME

CROSS-REFERENCE TO RELATED APPLICATION

This application claims priority from and the benefit of Korean Patent Application No. 10-2006-0112969, filed on Nov. 15, 2006, which is hereby incorporated by reference for all purposes as if fully set forth herein.

BACKGROUND OF THE INVENTION

1. Field of the Invention

The present invention relates to a display apparatus and a method of driving the same. More particularly, the present invention relates to a display apparatus that may have improved brightness and an improved contrast ratio and a method of driving the display apparatus.

2. Description of the Background

Generally, a liquid crystal display (LCD) apparatus includes a lower substrate, an upper substrate facing the lower substrate, and a liquid crystal layer interposed between the lower substrate and the upper substrate.

The lower substrate includes a plurality of pixels arranged in a plurality of pixel areas, respectively. The pixel areas are defined by gate lines and data lines that cross and are insulated from the gate lines. Each pixel includes a thin film transistor and a pixel electrode. The upper substrate includes a color filter layer, which includes a red color pixel, a green color pixel, and a blue color pixel, and a common electrode arranged on the color filter layer.

A conventional LCD apparatus further includes a backlight unit, which is arranged under the lower substrate, to generate a white light. The white light output from the backlight unit passes through the liquid crystal layer, and the transmittance of the white light is varied by the intensity of an electric field formed between the lower substrate and the upper substrate. The white light having the controlled transmittance passes through the red, green, and blue color pixels, so that a predetermined color may be displayed.

Recently, a color sequential display (CSD) mode LCD apparatus, in which an active period during which one pixel is turned on is divided into a red sub frame, a green sub frame, a blue sub frame, and a white sub frame, has been suggested. The CSD mode LCD apparatus further includes a backlight unit that sequentially generates a red light, a green light, a blue light, and a white light during the red, green, blue, and white sub frames, respectively. Since the CSD mode LCD apparatus adopting the backlight unit controls the transmittances of the red, green, blue, and white lights to express a predetermined color, the color filter layer arranged on the upper substrate may be omitted in the CSD mode LCD apparatus.

However, in a conventional CSD mode LCD apparatus, an LCD panel is selectively turned on according to the red, green, blue, and white sub frames. Moreover, when the LCD panel is operated in a black-white mode and displays an image having a white gray scale, the LCD panel is turned off during the red, green, and blue sub frames and turned on during only the white sub frame, which may result in deterioration of the brightness of the LCD apparatus.

SUMMARY OF THE INVENTION

The present invention provides a CSD mode display apparatus that may have improved brightness and an improved contrast ratio.

The present invention also provides a method of driving the CSD mode display apparatus.

Additional features of the invention will be set forth in the description which follows, and in part will be apparent from the description, or may be learned by practice of the invention.

The present invention discloses a display apparatus including a plurality of pixels, a backlight, a controller, a data driver, and a display panel. Each pixel is turned on during an active period that is divided into a red sub frame, a green sub frame, a blue sub frame, and a white sub frame. The backlight generates a red light, a green light, a blue light, and a white light during the red, green, blue, and white sub frames, respectively. The controller receives a first image data, a second image data, a third image data, and a fourth image data corresponding to the red, green, blue, and white sub frames, respectively, and compares a gray scale of the fourth image data with a reference gray scale. Also, the controller compensates the first, second, and third image data in accordance with the comparison result and outputs a first compensation data, a second compensation data, a third compensation data, and the fourth image data. The data driver outputs a first compensation voltage, a second compensation voltage, and a third compensation voltage corresponding to the first compensation data, the second compensation data, and the third compensation data during the red, green, and blue sub frames, respectively and outputs to a data voltage corresponding to the fourth image data during the white sub frame. The display panel displays an image in response to the first, second, and third compensation voltages that are input during the red, green, and blue sub frames, respectively, and in response to the data voltage input during the white sub frame.

The present invention also discloses a display apparatus including a plurality of pixels, a backlight, a controller, a data driver, and a display panel. Each pixel is turned on during an active period that is divided into a red sub frame, a green sub frame, a blue sub frame, and a white sub frame. The backlight generates a red light, a green light, a blue light, and a white light during the red, green, blue, and white sub frames, respectively. The controller receives a first image data, a second image data, a third image data, and a fourth image data corresponding to the red, green, blue, and white sub frames, respectively, to calculate a brightness of color based on the first, second, third, and fourth image data and compares the calculated brightness with a reference brightness. The controller compensates the first, second, third, and fourth image data in accordance with the comparison result and outputs a first compensation data, a second compensation data, a third compensation data, and a fourth compensation data. The data driver outputs a first compensation voltage, a second compensation voltage, a third compensation voltage, and a fourth compensation voltage corresponding to the first compensation data, the second compensation data, the third compensation data, and the fourth compensation data during the red, green, blue, and white sub frames, respectively. The display panel displays an image in response to the first, second, third, and fourth compensation voltages that are input during the red, green, blue, and white sub frames, respectively.

The present invention discloses a method of driving a display apparatus including a plurality of pixels, each of which is turned on during an active period that is divided into a red sub frame, a green sub frame, a blue sub frame, and a white sub frame. The method includes generating a red light, a green light, a blue light, and a white light during the red, green, blue and white sub frames, respectively, and receiving a first image data, a second image data, a third image data, and a fourth image data corresponding to the red, green, blue, and white sub frames, respectively. A gray scale of the fourth image data is compared with a reference gray scale. The first, second, and third image data are compensated in accordance with the comparison result, and a first compensation data, a second compensation data, a third compensation data, and the fourth image data are output. The first, second, and third compensation data are converted to a first compensation voltage, a second compensation voltage, and a third compensation voltage during the red, green and blue sub frames, respectively. Also, the fourth image data is converted to a data voltage during the white sub frame. An image is displayed in response to the first, second, and third compensation voltages during the red, green, and blue sub frames, respectively. Also, an image is displayed in response to the data voltage during the white sub frame.

The present invention also discloses a method of driving a display apparatus including a plurality of pixels, each of which is turned on during an active period that is divided into a red sub frame, a green sub frame, a blue sub frame, and a white sub frame. The method includes generating a red light, a green light, a blue light, and a white light during the red, green, blue, and white sub frames, respectively, and receiving a first image data, a second image data, a third image data, and a fourth image data corresponding to the red, green, blue, and white sub frames, respectively. A brightness of color based on the first, second, third, and fourth image data is calculated and the calculated brightness is compared with a reference brightness. The first, second, third, and fourth image data are compensated in accordance with the comparison result and the first, second, third, and fourth compensation data are output. The first, second, third, and fourth compensation data are converted to a first compensation voltage, a second compensation voltage, a third compensation voltage, and fourth compensation data during the red, green, blue, and white sub frames, respectively. An image is displayed in response to the first, second, third, and fourth compensation voltages during the red, green, blue, and white sub frames, respectively.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
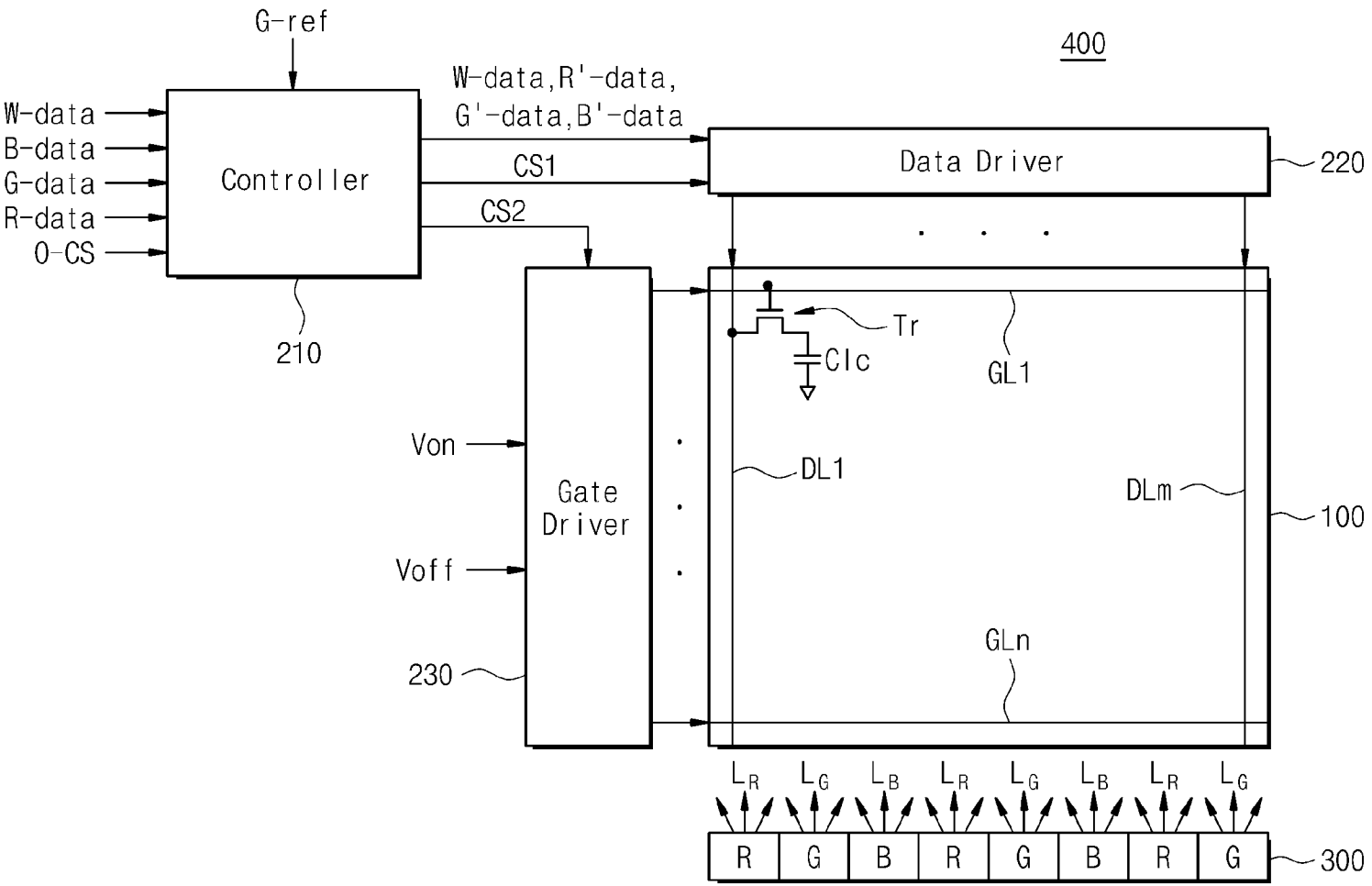
FIG. 1 is a block diagram showing an LCD apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Hereinafter, exemplary embodiments of the present invention will be explained in detail with reference to the accompanying drawings.

Figure 2:
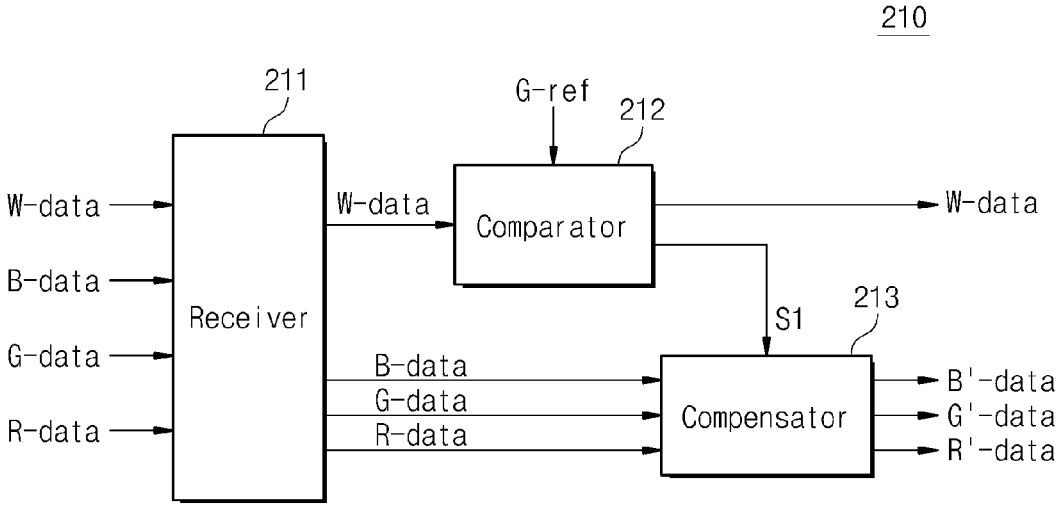
FIG. 2 is a block diagram showing a controller in FIG. 1.

FIG. 1 is a block diagram showing an LCD apparatus according to an exemplary embodiment of the present invention. FIG. 2 is a block diagram showing a controller in FIG. 1.

Referring to FIG. 1, an LCD apparatus 400 includes an LCD panel 100 to display an image, a driving unit 210, 220, and 230 to drive the LCD panel 100, and a backlight unit 300 to supply light to the LCD panel 100.

The LCD panel 100 includes first to $m^{th}$ data lines DL1~DLm, first to $n^{th}$ gate lines GL1~GLn, and n×m pixels. The first to $m^{th}$ data lines DL1~DLm cross and are insulated from the first to $n^{th}$ gate lines GL1~GLn to define n×m pixel areas in a matrix configuration. The n×m pixels are arranged in the n×m pixel areas, respectively.

Each pixel includes a thin film transistor Tr and a liquid crystal capacitor Clc. In the present exemplary embodiment, the thin film transistor Tr of a first pixel includes a gate electrode connected to the first gate line GL1, a source electrode connected to the first data line DL1, and a drain electrode connected to a pixel electrode that serves as a first electrode of the liquid crystal capacitor Clc. The pixel electrode faces a common electrode, to which a common voltage is applied, and a liquid crystal layer is interposed between the pixel electrode and the common electrode. The liquid crystal capacitor Clc is defined by the pixel electrode, the common electrode, and the liquid crystal layer that serves as a dielectric. Therefore, the liquid crystal capacitor Clc is charged with a voltage corresponding to an electric potential difference between a data voltage applied to the pixel electrode and the common voltage applied to the common electrode, so that the liquid crystal capacitor Clc may control light transmittance.

The backlight unit 300 includes a plurality of red light sources R, a plurality of green light sources G, and a plurality of blue light sources B. In the present exemplary embodiment, each of the red, green, and blue light sources R, G, and B may include a light emitting diode.

When a time during which the LCD panel 100 displays a screen is defined as a frame, an active period during which a pixel row is turned on is equal to a duration obtained by dividing the frame by the number of the gate lines. In the present exemplary embodiment, the active period may be divided into equal four periods, namely, a red sub frame, a green sub frame, a blue sub frame, and a white sub frame.

The red light source R is turned on during the red sub frame of the active period and supplies a red light $L_R$ to the LCD panel 100, and the green light source G is turned on during the green sub frame of the active period and supplies a green light $L_G$ to the LCD panel 100. Also the blue light source B is turned on during the blue sub frame of the active period and supplies the blue light $L_B$ to the LCD panel 100. The red, green, and blue light sources R, G, and B are simultaneously turned on and generate a white light during the white sub frame, and the generated white light is supplied to the LCD panel 100 during the white sub frame.

The driving unit includes a controller 210, a data driver 220, and a gate driver 230.

The controller 210 receives an external control signal O-CS, red image data R-data, green image data G-data, blue image data B-data, and white image data W-data from an external source (not shown). In the present exemplary embodiment, the external control signal O-CS may include a vertical synchronizing signal, a horizontal synchronizing signal, a main clock, a data enable signal, etc. The controller 210 generates a data control signal CS1 and a gate control signal CS2 based on the external control signal O-CS.

As shown in FIG. 2, in a black-white operation mode, the controller 210 includes a receiver 211, a comparator 212, and a compensator 213. The receiver 211 receives the red, green, blue, and white image data R-data, G-data, B-data, and W-data from the external source. The white image data W-data corresponding to the white sub frame is applied to the comparator 212.

The comparator 212 receives the white image data W-data and a predetermined reference gray scale G-ref and compares a gray scale of the white image data W-data with the reference gray scale G-ref. The comparator 212 outputs a first result signal S1 corresponding to the result of the comparison between the gray scale of the white image data W-data and the reference gray scale G-ref, and the first result signal S1 is applied to the compensator 213.

The compensator 213 controls gray scale levels of the red, green, and blue image data R-data, G-data, and B-data in response to the first result signal S1 to compensate the red, green, and blue image data R-data, G-data, and B-data, and outputs red compensation data R'-data, green compensation data G'-data, and blue compensation data B'-data.

More specifically, when the gray scale of the white image data W-data is less than the reference gray scale G-ref, the compensator 213 outputs red, green, and blue compensation data R'-data, G'-data, and B'-data, each of which has a black gray scale. Also, when the gray scale of the white image data W-data is greater than the reference gray scale G-ref, the compensator 213 outputs the red, green, and blue compensation data R'-data, G'-data, and B'-data, each of which has a predetermined gray scale. In the present exemplary embodiment, the gray scale value of the red, green, and blue compensation data R'-data, G'-data, and B'-data may vary in accordance with the result of the comparison between the gray scale of the white image data W-data and the reference gray scale G-ref. The compensation process of the compensator 213 will be described later with reference to FIG. 3A, FIG. 3B, FIG. 3C, and FIG. 3D. On the other hand, the white image data W-data output from the comparator 212 is the same as the white image data W-data input to the controller 210.

The controller 210 sequentially applies the red compensation data R'-data, the green compensation data G'-data, the blue compensation data B'-data, and the white image data W-data to the data driver 220 in synchronization with the data control signal CS1 during the red, green, blue, and white sub frames, respectively. In the present exemplary embodiment, the data control signal CS1 includes a horizontal start signal to start an operation of the data driver 220, a reverse signal to reverse a polarity of a data voltage, and an output command signal to determine the time at which the data voltage is output from the data driver 220.

The data driver 220 sequentially outputs a red compensation voltage, a green compensation voltage, and a blue compensation voltage corresponding to the red, green, and blue compensation data R'-data, G'-data, and B'-data during the red, green, and blue sub frames, respectively. Then, the data driver 220 outputs a white data voltage corresponding to the white image data W-data during the white sub frame. The red compensation voltage, the green compensation voltage, the blue compensation voltage, and the white data voltage are sequentially applied to the first to $m^{th}$ data lines DL1~DLm arranged in the LCD panel 100.

The gate driver 230 sequentially outputs a gate pulse that swings between a gate on voltage Von and a gate off voltage Voff in response to the gate control signal CS2 from the controller 210. In the present exemplary embodiment, the gate control signal CS2 includes a vertical start signal to start an operation of the gate driver 230, a gate clock signal to determine the time at which the gate pulse is output from the gate driver 230, and an output enable signal to determine a width of the gate pulse.

The gate pulse is sequentially applied to the first to $n^{th}$ gate lines GL1~GLn arranged in the LCD panel 100. Thus, the LCD panel 100 is turned on in response to the gate pulse and displays an image corresponding to the white data voltage during the white sub frame. Also, the LCD panel 100 sequentially receives the red, green, and blue compensation voltages during the red, green, and blue sub frames, respectively, so the brightness of the image displayed on the LCD panel 100 may be improved.

FIG. 3A, FIG. 3B, FIG. 3C, and FIG. 3D are graphs showing a change in transmittance according to a time sequence in a black-white operation mode.

Figure 3A:
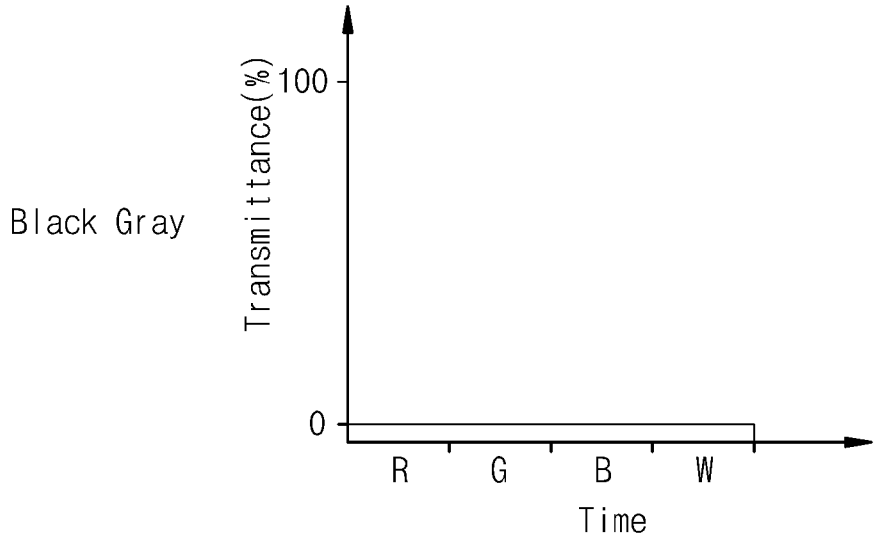
FIG. 3A, FIG. 3B, FIG. 3C, and FIG. 3D are graphs showing a change of a transmittance according to a time sequence in a black-white operation mode.

Referring to FIG. 3A, when an image having a black gray scale is displayed on an LCD panel 100 (refer to FIG. 1) that is being operated in the black-white operation mode, the transmittance of the LCD panel 100 is about 0% during the red, green, blue, and white sub frames. In particular, if the white data voltage has the black gray scale during the white sub frame, the red, green, and blue compensation voltages have a gray scale level corresponding to the black gray scale during the red, green, blue, and white sub frames, respectively. Therefore, the transmittance of the LCD panel 100 is continuously maintained at about 0% during the red, green, blue, and white sub frames, so that the LCD panel 100 may display an image having the black gray scale.

Figure 3B:
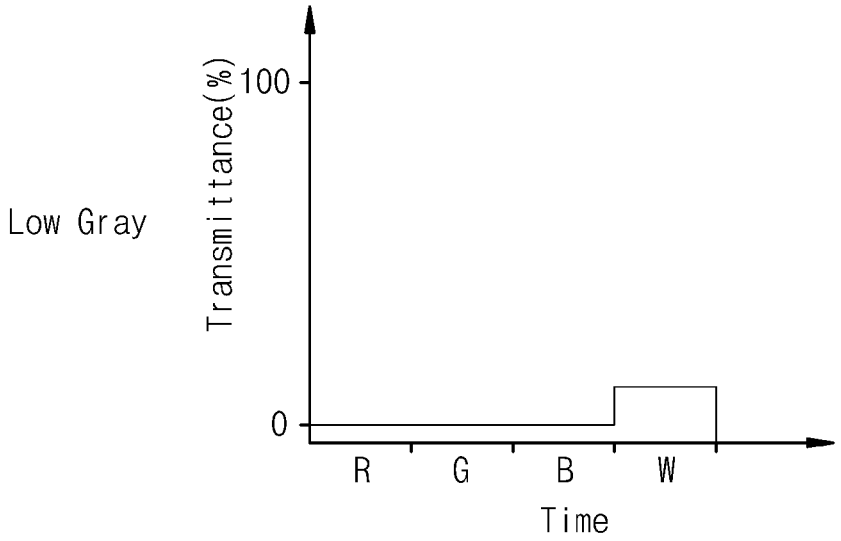

Referring to FIG. 3B, when an image having a lower gray scale than the reference gray scale G-ref (refer to FIG. 2) is displayed on an LCD panel 100 that is being operated in the black-white operation mode, the transmittance of the LCD panel 100 is about 0% during the red, green, and blue sub frames, and the transmittance of the LCD panel 100 corresponds the transmittance of the white data voltage having the lower gray scale during the white sub frame. In particular, since each of the red, green, and blue compensation voltages has a gray scale level corresponding to the black gray scale during the red, green, and blue sub frames, the LCD panel 100 has a transmittance of about 0% during red, green, and blue sub frames and a transmittance corresponding to the white data voltage during the white sub frame. Thus, the LCD panel 100 may display the image having the lower gray scale.

Figure 3C:
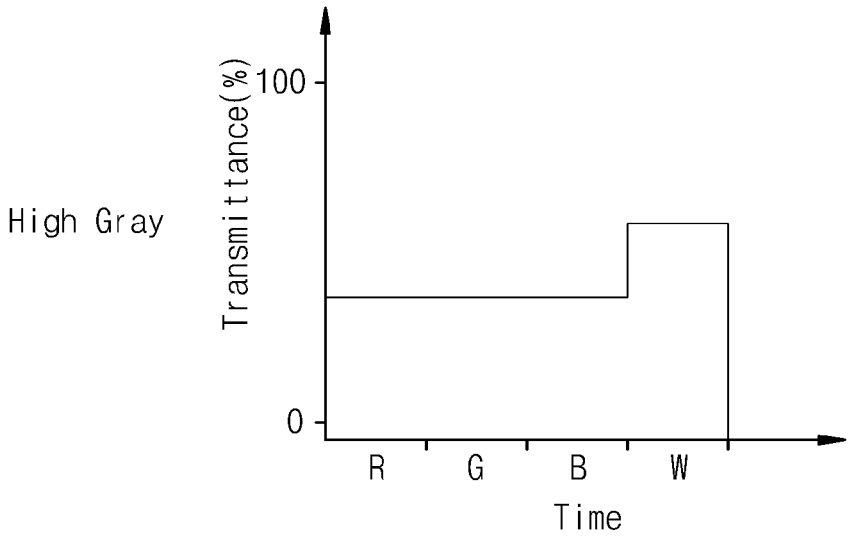

Referring to FIG. 3C, when an image having a higher gray scale than the reference gray scale G-ref is displayed on an LCD panel 100 that is being operated in the black-white operation mode, the transmittance of the LCD panel 100 is greater than about 0% during the red, green, and blue sub frames, and has a transmittance corresponding to the white data voltage during the white sub frame. The transmittance of the LCD panel 100 may have a predetermined value in accordance with a gray scale of the white image data during the red, green, and blue sub frames.

In the present exemplary embodiment, since the red, green, and blue compensation voltages have an intermediate gray scale level that is higher than the black gray scale and lower than the gray scale of the white image data, the transmittance of the LCD panel 100 is greater than about 0% during the red, green, and blue sub frames. Also, the transmittance of the LCD panel 100 corresponds to the white data voltage during the white sub frame. As a result, the LCD panel 100 may display the image having an intermediate gray scale during the red, green, and blue sub frames, thereby improving the entire brightness of the LCD panel 100 on which the image having the higher gray scale is displayed during the white sub frame.

Figure 3D:
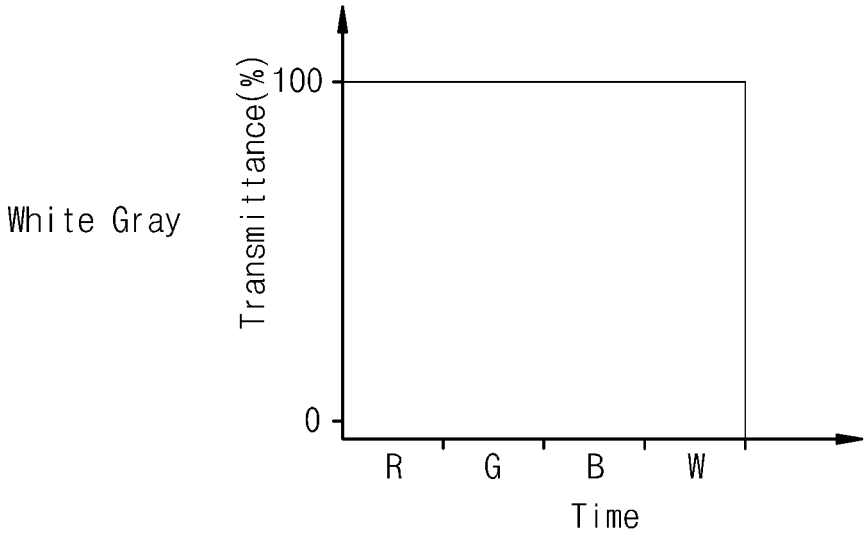

Referring to FIG. 3D, when the image having the white gray scale is displayed on an LCD panel 100 that is being operated in the black-white operation mode, the transmittance of the LCD panel 100 is about 100% during the red, green, blue, and white sub frames.

Since each of the red, green, and blue compensation voltages has a gray scale level corresponding to the white gray scale during the red, green, and blue sub frames, the LCD panel 100 has the transmittance of about 100%. Also, the white data voltage has the gray scale level corresponding to the white gray scale during the white sub frame, so the transmittance of the LCD panel 100 is about 100%.

As described above, the image having the white gray scale is continuously displayed on the LCD panel 100 during the red, green, blue sub frames, even when the image having the white gray scale is displayed on the LCD panel 100 during the white sub frame, which may improve the brightness of the image displayed on the LCD panel 100.

Figure 4:
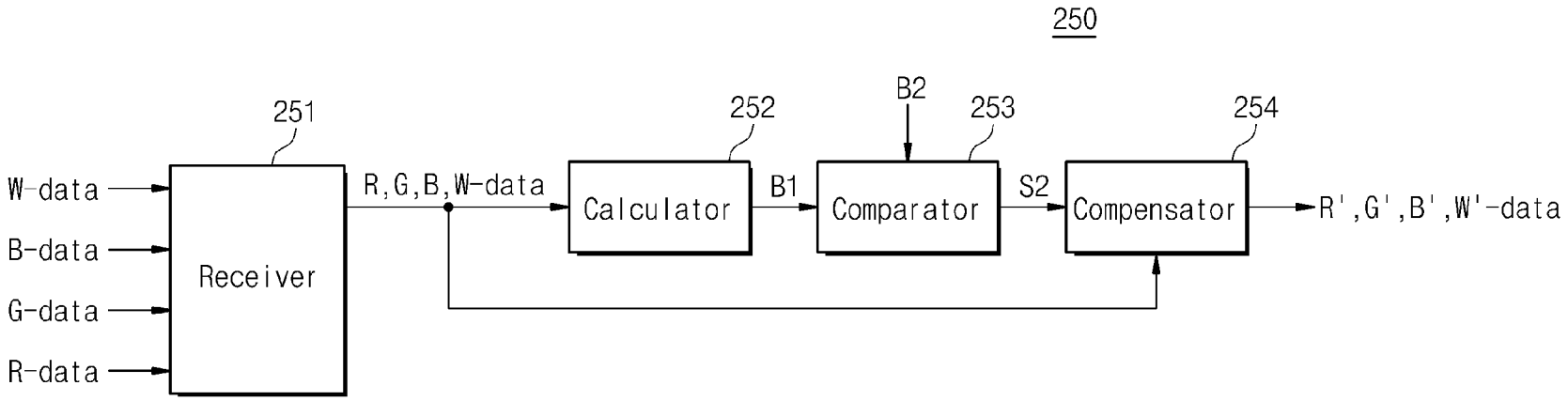
FIG. 4 is a block diagram showing a controller according to another exemplary embodiment of the present invention.

FIG. 4 is a block diagram showing a controller according to another exemplary embodiment of the present invention.

Referring to FIG. 4, a controller 250 includes a receiver 251, a calculator 252, a comparator 253, and a compensator 254.

The receiver 251 receives the red, green, blue, and white image data R-data, G-data, B-data and W-data from the external source and supplies the red, green, blue, and white image data R-data, G-data, B-data, and W-data to the calculator 252. The calculator 252 calculates a brightness of color based on the gray scale levels of the red, green, blue, and white image data R-data, G-data, B-data, and W-data. The comparator 253 receives the calculated brightness B1 from the calculator 252 and compares the calculated brightness B1 with a reference brightness B2. The comparator 253 outputs a second result signal S2 in accordance with the result of a comparison between the calculated brightness B1 and the reference brightness B2. The second result signal S2 is applied to the compensator 254.

The compensator 254 controls the gray scale levels of the red, green, blue, and white image data R-data, G-data, B-data and W-data in response to the second result signal S2, and outputs a red compensation data R'-data, a green compensation data G'-data, a blue compensation data B'-data, and a white compensation data W'-data.

More specifically, when the calculated brightness B1 is less than the reference brightness B2, the red, green, blue, and white compensation data R'-data, G'-data, B'-data, and W'-data have same values as those of the red, green, blue, and white image data R-data, G-data, B-data, and W-data, respectively. On the contrary, when the calculated brightness B1 is greater than the reference brightness B2, the compensator 254 outputs the red, green, blue, and white compensation data R'-data, G'-data, B'-data, and W'-data, each having a gray scale higher than that of the red, green, blue, and white image data R-data, G-data, B-data, and W-data.

Hereinafter, the compensation process of the compensator 254 will be described in detail with reference to FIG. 5A, FIG. 5B, FIG. 5C, and FIG. 5D.

Figure 6:
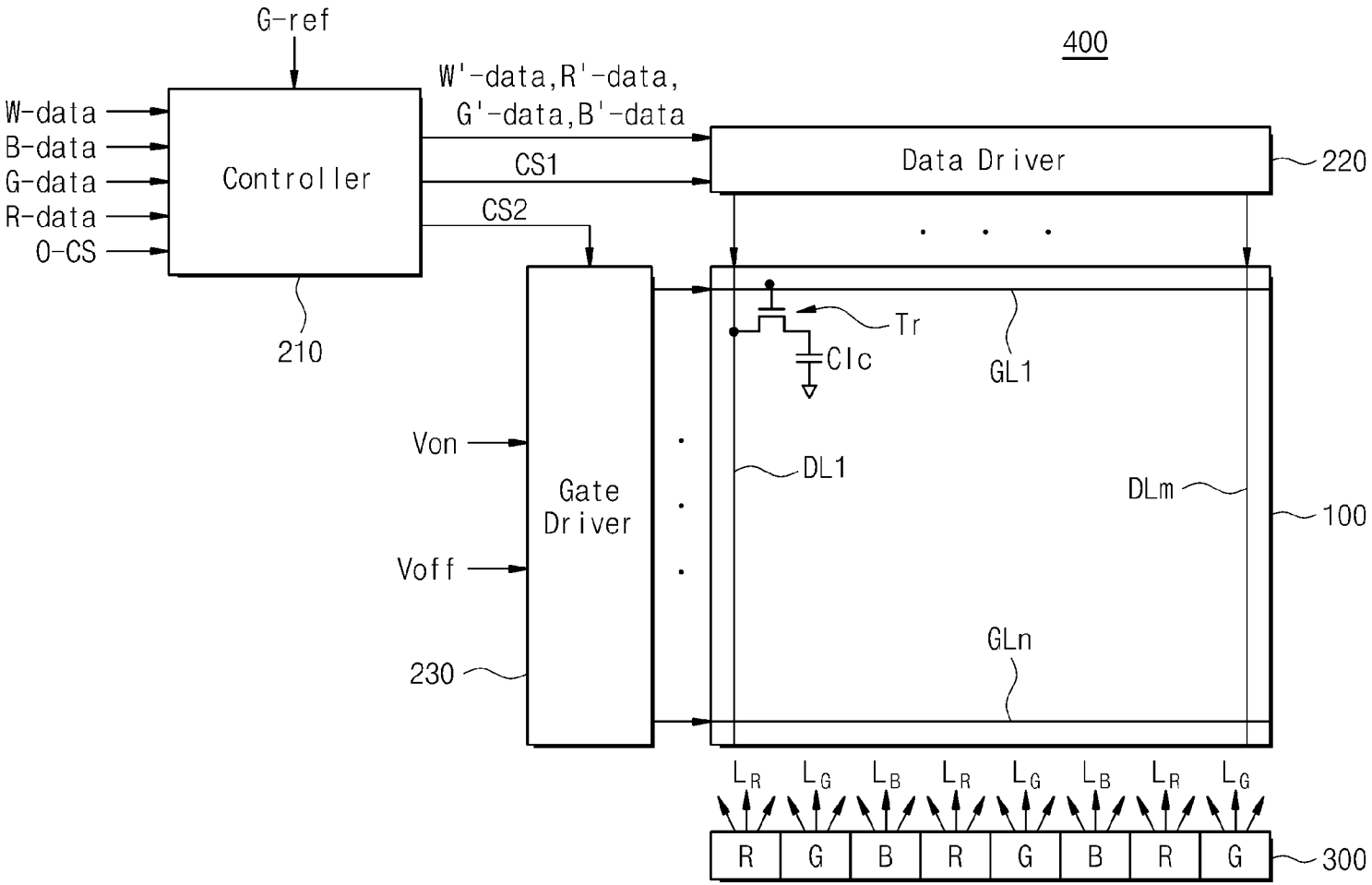
FIG. 6 is a block diagram showing an LCD apparatus including the controller the shown in FIG. 4.

As shown in FIG. 6, the red, green, blue, and white compensation data R'-data, G'-data, B'-data, and W'-data output from the compensator 254 are applied to the data driver 220. The data driver 220 generates a red data voltage, a green data voltage, a blue data voltage, and a white data voltage corresponding to the red, green, blue, and white compensation data R'-data, G'-data, B'-data, and W'-data, respectively, to sequentially output the red, green, blue, and white data voltages during the red, green, blue, and white sub frames, respectively.

FIG. 5A, FIG. 5B, FIG. 5C, and FIG. 5D are graphs showing a change in transmittance according to a time sequence in a color operation mode.

Figure 5A:
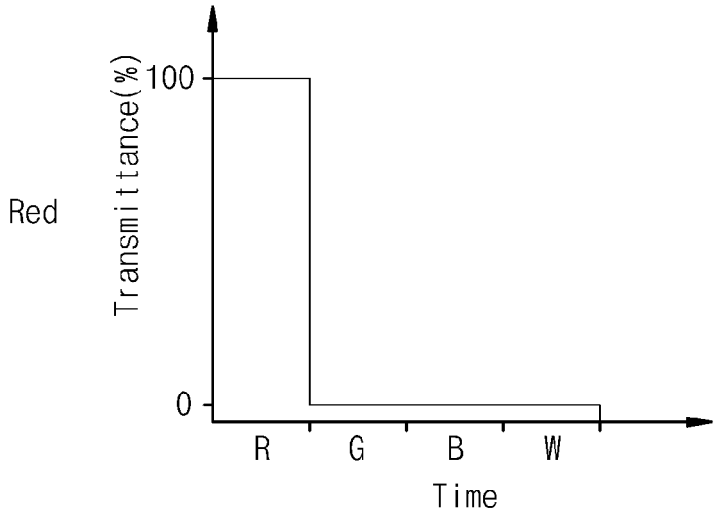
FIG. 5A, FIG. 5B, FIG. 5C, and FIG. 5D are graphs showing a change in transmittance according to a time sequence in a color operation mode.

Referring to FIG. 5A, when a red color is displayed on an LCD panel 100 (refer to FIG. 1) that is being operated in the color operation mode, the transmittance of the LCD panel 100 is about 100% during the red sub frame and about 0% during the green, blue, and white sub frames. That is, the LCD panel 100 displays the red color in response to the red data voltage corresponding to the red image data during the red sub frame. Meanwhile, since the green, blue, and white data voltages are not applied to the LCD panel 100 during the green, blue, and white sub frames, the pixels arranged in the LCD panel 100 are turned off, so the transmittance of the LCD panel 100 is about 0% during the green, blue, and white sub frames. As a result, the LCD panel 100 may display an image having the red color thereon.

Figure 5B:
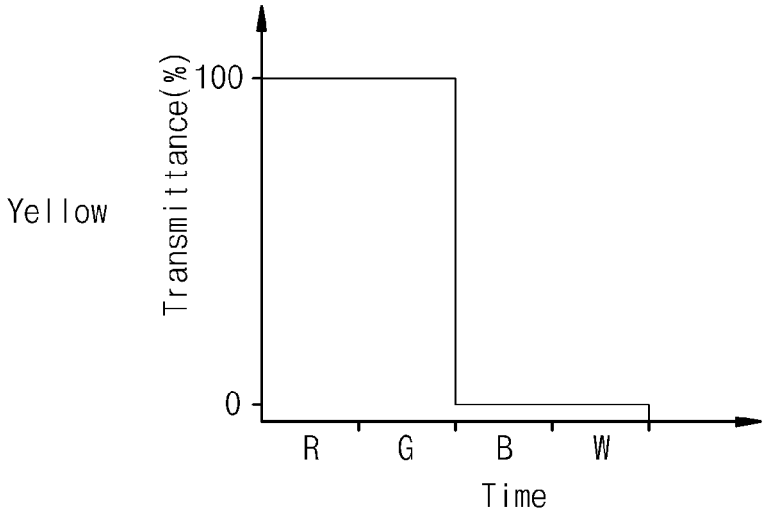

Referring to FIG. 5B, when a yellow color is displayed on an LCD panel 100 that is being operated in the color operation mode, the transmittance of the LCD panel is about 100% during the red and green sub frames and about 0% during the blue and white sub frames. That is, the LCD panel 100 displays the yellow color in response to the red and green data voltages respectively corresponding to the red and green image data during the red and green sub frames. Meanwhile, since the blue and white data voltages are not applied to the LCD panel 100 during the blue and white sub frames, the pixels arranged in the LCD panel 100 are turned off, so the transmittance of the LCD panel 100 is about 0% during the blue and white sub frames. As a result, the LCD panel 100 may display an image having the yellow color.

As shown in FIG. 5A and FIG. 5B, since a data voltage corresponding to a transmittance of about 100% is applied to the LCD panel 100 when a primary color is displayed on the LCD panel 100, the brightness and the contrast ratio of the LCD panel 100 may be maintained.

Figure 5C:
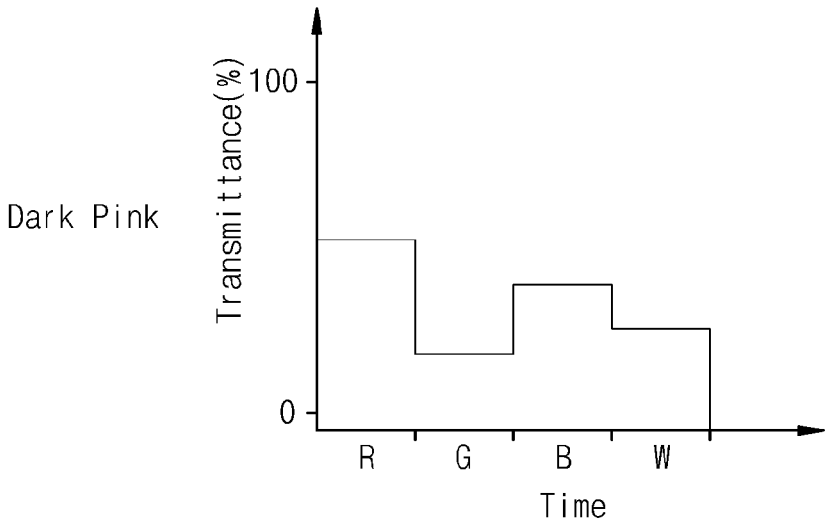

Referring to FIG. 5C, when a dark pink color is displayed on an LCD panel 100 that is being operated in the color operation mode, the transmittance of the LCD panel 100 may vary in each of the red, green, blue, and white sub frames. When the dark pink color has a brightness lower than a predetermined reference brightness, the red, green, blue, and white compensation data have same values as those of the red, green, blue, and white image data, respectively. Therefore, the red, green, blue, and white data voltages corresponding to the red, green, blue, and white image data are sequentially applied to the LCD panel 100, so the dark pink color may be displayed on the LCD panel 100.

Figure 5D:
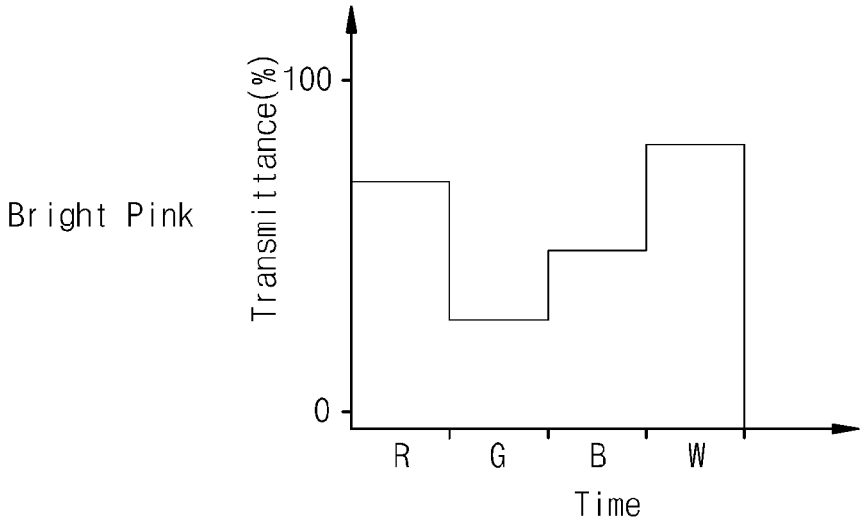

Referring to FIG. 5D, when a bright pink color is displayed on an LCD panel 100 that is being operated in the color operation mode, the transmittance of the LCD panel 100 may vary in each of the red, green, blue, and white sub frames. When the bright pink color has a brightness higher than the reference brightness, the red, green, blue, and white compensation data have a gray scale value that is greater than the red, green, blue, and white image data. Therefore, the red, green, blue, and white compensation voltages corresponding to the red, green, blue, and white compensation data are sequentially applied to the LCD panel 100. Consequently, the brightness of the bright pink color may be improved, which may improve the brightness and the contrast ratio of the LCD panel 100.

According to the above, the gray scale values of the image data corresponding to the red, green, and blue sub frames are compensated in accordance with the gray scale value of image data corresponding to the white sub frame, so that the brightness of the display apparatus may be improved.

Also, since the brightness of color is calculated based on the image data corresponding to the red, green, blue, and white sub frames and the gray scale values of the image data are compensated according to the calculated brightness, the brightness and the contrast ratio of the display apparatus may be improved.

It will be apparent to those skilled in the art that various modifications and variations can be made in the present invention without departing from the spirit or scope of the invention. Thus it is intended that the present invention cover the modifications and variations of this invention provided they come within the scope of the appended claims and their equivalents.

What is claimed is:

1. A display apparatus, comprising:

a plurality of pixels, each of which is turned on during an active period that is divided into a red sub frame, a green sub frame, a blue sub frame, and a white sub frame;

a backlight to generate a red light, a green light, a blue light, and a white light during the red sub frame, the green sub frame, the blue sub frame, and the white sub frame, respectively;

a controller to receive a first image data, a second image data, a third image data, and a fourth image data corresponding to the red sub frame, the green sub frame, the blue sub frame, and the white sub frame, respectively, to compare a gray scale of the fourth image data with a reference gray scale, in order to determine whether the fourth image data is greater than or less than the reference gray scale, to compensate the first image data, the second image data, and the third image data in accordance with the comparison result, and to output a first compensation data, a second compensation data, a third compensation data, and the fourth image data;

a data driver to output a first compensation voltage, a second compensation voltage, and a third compensation voltage corresponding to the first compensation data, the second compensation data, and the third compensation data during the red sub frame, the green sub frame, and blue sub frame, respectively, and to output a data voltage corresponding to the fourth image data during the white sub frame; and a display panel to display an image in response to the first compensation voltage, the second compensation voltage, and the third compensation voltage that are input during the red sub frame, the green sub frame, and the blue sub frame, respectively, and in response to the data voltage input during the white sub frame, wherein the reference grayscale is independent of the first, second, third, and fourth image data.

2. The display apparatus of claim 1, wherein the controller comprises:

a receiver to receive the first image data, the second image data, the third image data, and the fourth image data;

a comparator to compare the gray scale of the fourth image data provided from the receiver with the reference gray scale and to output a control signal corresponding to the comparison result; and a compensator to receive the first image data, the second image data, and the third image data from the receiver and compensate the first image data, the second image data, and third image data in response to the control signal to output the first compensation data, the second compensation data, and the third compensation data.

3. The display apparatus of claim 2, wherein the compensator compensates the first image data, the second image data, and the third image data to output the first compensation data, the second compensation data, and the third compensation data having a compensation gray scale when the gray scale of the fourth image data is greater than the reference gray scale.

4. The display apparatus of claim 3, wherein the first compensation data, the second compensation data, and the third compensation data have a black gray scale when the gray scale of the fourth image data is less than the reference gray scale.

5. The display apparatus of claim 3, wherein the compensation gray scale is less than the gray scale of the fourth image data and greater than a black gray scale when the gray scale of the fourth image data is greater than the reference gray scale and less than a white gray scale.

6. The display apparatus of claim 3, wherein the compensation gray scale is equal to the gray scale of the fourth image data when the gray scale of the fourth image data is equal to a white gray scale.

7. The display apparatus of claim 1, wherein the backlight comprises a red light source, a green light source, and a blue light source that are turned on during the red sub frame, the green sub frame, and the blue sub frame, respectively to generate the red light, the green light, and the blue light, and the red light source, the green light source, and the blue light source are turned on during the white sub frame to generate the white light.

8. A display apparatus, comprising:

a plurality of pixels, each of which is turned on during an active period that is divided into a red sub frame, a green sub frame, a blue sub frame, and a white sub frame;

a backlight to generate a red light, a green light, a blue light, and a white light during the red sub frame, the green sub frame, the blue sub frame, and the white sub frame, respectively;

a controller to receive a first image data, a second image data, a third image data, and a fourth image data corresponding to the red sub frame, the green sub frame, the blue sub frame blue, and the white sub frame, respectively, to calculate a brightness of color based on the first image data, the second image data, the third image data, and the fourth image data and compare the calculated brightness with a reference brightness, in order to determine whether the fourth image data is greater than or less than the reference brightness, to compensate the first image data, the second image data, the third image data, and the fourth image data in accordance with the comparison result, and to output a first compensation data, a second compensation data, a third compensation data, and a fourth compensation data;

a data driver to output a first compensation voltage, a second compensation voltage, a third compensation voltage, and a fourth compensation voltage corresponding to the first compensation data, the second compensation data, the third compensation data, and the fourth compensation data during the red sub frame, the green sub frame, the blue sub frame, and the white sub frame, respectively; and a display panel to display an image in response to the first compensation voltage, the second compensation voltage, the third compensation voltage, and the fourth compensation voltage that are input during the red sub frame, the green sub frame, the blue sub frame, and white sub frame, respectively, wherein the reference brightness is independent of the first, second, third, and fourth image data.

9. The display apparatus of claim 8, wherein the controller comprises:

a receiver to receive the first image data, the second image data, the third image data, and the fourth image data;

a calculator to calculate the brightness of color based on the first image data, the second image data, the third image data, and the fourth image data provided from the receiver;

a comparator to compare the calculated brightness provided from the calculator with the reference brightness and output a control signal corresponding to the comparison result; and a compensator to compensate the first image data, the second image data, the third image data, and the fourth image data in response to the control signal and output the first compensation data, the second compensation data, the third compensation data, and the fourth compensation data.

10. The display apparatus of claim 9, wherein the compensator outputs the first compensation data, the second compensation data, the third compensation data, and the fourth compensation data having the same value as the first image data, the second image data, the third image data, and the fourth image data, respectively, when the calculated brightness is less than the reference brightness, and compensates the first image data, the second image data, the third image data, and the fourth image data to output the first compensation data, the second compensation data, the third compensation data, and the fourth compensation data having a gray scale increased by a compensation value when the calculated brightness is greater than the reference brightness.

11. A method of driving a display apparatus comprising a plurality of pixels each of which is turned on during an active period that is divided into a red sub frame, a green sub frame, a blue sub frame, and a white sub frame, the method comprising:

generating a red light, a green light, a blue light, and a white light during the red sub frame, the green sub frame, the blue sub frame, and the white sub frame, respectively;

receiving a first image data, a second image data, a third image data, and a fourth image data corresponding to the red sub frame, the green sub frame, the blue sub frame, and the white sub frame, respectively;

comparing a gray scale of the fourth image data with a reference gray scale, in order to determine whether the fourth image data is greater than or less than the reference gray scale;

compensating the first image data, the second image data, and the third image data in accordance with the comparison result;

outputting a first compensation data, a second compensation data, a third compensation data, and the fourth image data;

converting the first compensation data, the second compensation data, and the third compensation data to a first compensation voltage, a second compensation voltage, and a third compensation voltage during the red sub frame, the green sub frame, and the blue sub frame, respectively;

converting the fourth image data to a data voltage during the white sub frame;

displaying an image in response to the first compensation voltage, the second compensation voltage, and the third compensation voltage during the red sub frame, the green sub frame, and the blue sub frame, respectively; and displaying an image in response to the data voltage during the white sub frame, wherein the reference grayscale is independent of the first, second, third, and fourth image data.

12. The method of claim 11, wherein outputting of the first compensation data, the second compensation data, the third compensation data, and the fourth image data comprises:

outputting the first compensation data, the second compensation data, and the third compensation data having a black gray scale when the gray scale of the fourth image data is less than the reference gray scale; and compensating the first image data, the second image data, and the third image data to output the first compensation data, the second compensation data, and the third compensation data having a compensation gray scale when the gray scale of the fourth image data is greater than the reference gray scale.

13. A method of driving a display apparatus comprising a plurality of pixels, each of which is turned on during an active period that is divided into a red sub frame, a green sub frame, a blue sub frame, and a white sub frame, the method comprising:

generating a red light, a green light, a blue light, and a white light during the red sub frame, the green sub frame, the blue sub frame, and the white sub frame, respectively;

receiving a first image data, a second image data, a third image data, and a fourth image data corresponding to the red sub frame, the green sub frame, the blue sub frame, and the white sub frame, respectively;

calculating the brightness of color based on the first image data, the second image data, the third image data, and the fourth image data;

comparing the calculated brightness with a reference brightness, in order to determine whether the calculated brightness is greater than or less than the reference brightness;

compensating the first image data, the second image data, the third image data, and the fourth image data in accordance with the comparison result;

outputting the first compensation data, the second compensation data, the third compensation data, and fourth compensation data;

converting the first compensation data, the second compensation data, the third compensation data, and the fourth compensation data to a first compensation voltage, a second compensation voltage, a third compensation voltage, and fourth compensation voltage during the red sub frame, green sub frame, blue sub frame, and white sub frame, respectively; and displaying an image in response to the first compensation voltage, the second compensation voltage, the third compensation voltage, and the fourth compensation voltage during the red sub frame, the green sub frame, the blue sub frame, and the white sub frame, respectively, wherein the reference brightness is independent of the first, second, third, and fourth image data.

14. The method of claim 13, wherein the outputting the first compensation data, the second compensation data, the third compensation data, and the fourth compensation data comprises:

outputting the first compensation data, the second compensation data, the third compensation data, and the fourth compensation data having the same value as the first image data, the second image data, the third image data, and the fourth image data when the calculated brightness is less than the reference brightness; and compensating the first image data, the second image data, the third image data, and fourth image data to output the first compensation data, the second compensation data, the third compensation data, and the fourth compensation data having a gray scale increased by a compensation value when the calculated brightness is greater than the reference brightness.

* * * * *